US006267393B1

(12) United States Patent
Mengrone et al.

(10) Patent No.: US 6,267,393 B1
(45) Date of Patent: Jul. 31, 2001

(54) WHEELED PERSONAL ITEM CADDY

(76) Inventors: Frank Mengrone; Deborah Mengrone, both of 31 A Cooper Ter., Staten Island, NY (US) 10314

( * ) Notice: Subject to any disclaimer, the term of this patent is extended or adjusted under 35 U.S.C. 154(b) by 0 days.

(21) Appl. No.: 09/370,001

(22) Filed: Aug. 6, 1999

(51) Int. Cl.[7] ..... B62B 1/12

(52) U.S. Cl. ..... 280/37; 280/652; 280/30; 280/47.24; 280/43.24; 312/258

(58) Field of Search ..... 280/37, 35, 30, 280/47.131, 652, 651, 47.24, 47.17, 47.18, 43.24; 312/205, 257, 258, 262, 350

(56) References Cited

U.S. PATENT DOCUMENTS

| | | | | |
|---|---|---|---|---|
| 2,439,992 | * | 4/1948 | Simonian | 280/37 |
| 2,555,767 | * | 6/1951 | Simonian | 280/37 |
| 2,564,939 | * | 8/1951 | Weast | 280/30 |
| 2,840,142 | * | 6/1958 | Haug | 280/30 |
| 3,092,395 | * | 6/1963 | Mitty et al. | 280/652 |
| 3,135,527 | * | 6/1964 | Knapp | 280/654 |
| 3,204,975 | | 9/1965 | McCarty | 280/35 |
| 3,310,317 | | 3/1967 | Luff | 280/36 |
| 3,313,378 | | 4/1967 | Freeman | 188/21 |
| 4,109,926 | | 8/1978 | Lane | 280/39 |
| 4,951,818 | | 8/1990 | Johnson | 206/315.1 |
| 5,464,237 | * | 11/1995 | Saporiti | 280/30 |
| 5,749,446 | * | 5/1998 | Hsieh | 280/37 |
| 6,073,943 | * | 6/2000 | Serrault | 280/30 |

* cited by examiner

*Primary Examiner*—Michael Mar
*Assistant Examiner*—Hau Phan
(74) *Attorney, Agent, or Firm*—Goldstein Law Offices, P.C.

(57) ABSTRACT

A caddy for allowing easy storage and transporting of personal items, having a rear panel. A bottom panel and a top panel are hingeably mounted to the rear panel such that they are capable of extending substantially perpendicularly from the rear panel during use, and extending substantially parallel to the rear panel for storage. A storage compartment is defined by a partition which extends parallel to the rear panel, soft side panels which extend between the partition and rear panel, and the top and bottom panels. The partition is movable toward the rear panel for storage. Wheels are provided immediately below the rear panel, and a handle is provided thereon to facilitate transportation and use of the caddy.

4 Claims, 4 Drawing Sheets

WHEELED PERSONAL ITEM CADDY

BACKGROUND OF THE INVENTION

The invention relates to a personal item caddy. More particularly, the invention relates to a wheeled caddy which allows a variety of personal items to be easily carried, which is therefore particularly well suited for use while shopping.

When shopping, one can quickly acquire numerous bags and packages. Often, the burden of carrying the newly acquired belongings can be overwhelming, either causing a person to cut the shopping trip short, hand-off the bags to family members, or just suffer under the burden of a pile of unwieldy packages. Further, it is quite common during a shopping trip for one to place his or her bags on the ground for a rest. A shopper then runs the risk of losing or forgetting one of the bags.

Conventional shopping carts fail to provide an effective solution, since they are unsightly and inconvenient to store. Wheeled luggage is also not particularly useful for shopping, since luggage is not designed or configured for frequent and convenient access such as would ordinarily be necessary while shopping.

While these units may be suitable for the particular purpose employed, or for general use, they would not be as suitable for the purposes of the present invention as disclosed hereafter.

SUMMARY OF THE INVENTION

It is an object of the invention to produce a personal item caddy which provides storage for a variety of personal items, and allows convenient and immediate access to all of said items.

It is another object of the invention to provide a personal item caddy which is portable. Accordingly, the caddy is wheeled so as to be easily transportable over a variety of surfaces.

It is a further object of the invention to provide a caddy which itself is easily storable. Accordingly, the caddy may be configured so that it fully collapses into a flat storage position, and then may be selectively expanded for use thereof.

The invention is a caddy for allowing easy storage and transporting of personal items, comprising a rear panel. A bottom panel and a top panel are hingeably mounted to the rear panel such that they are capable of extending substantially perpendicularly from the rear panel during use, and extending substantially parallel to the rear panel for storage. A storage compartment is defined by a partition which extends parallel to the rear panel, soft side panels which extend between the partition and rear panel, and the top and bottom panels. The partition is movable toward the rear panel for storage. Wheels are provided immediately below the rear panel, and a handle is provided thereon to facilitate transportation and use of the caddy To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
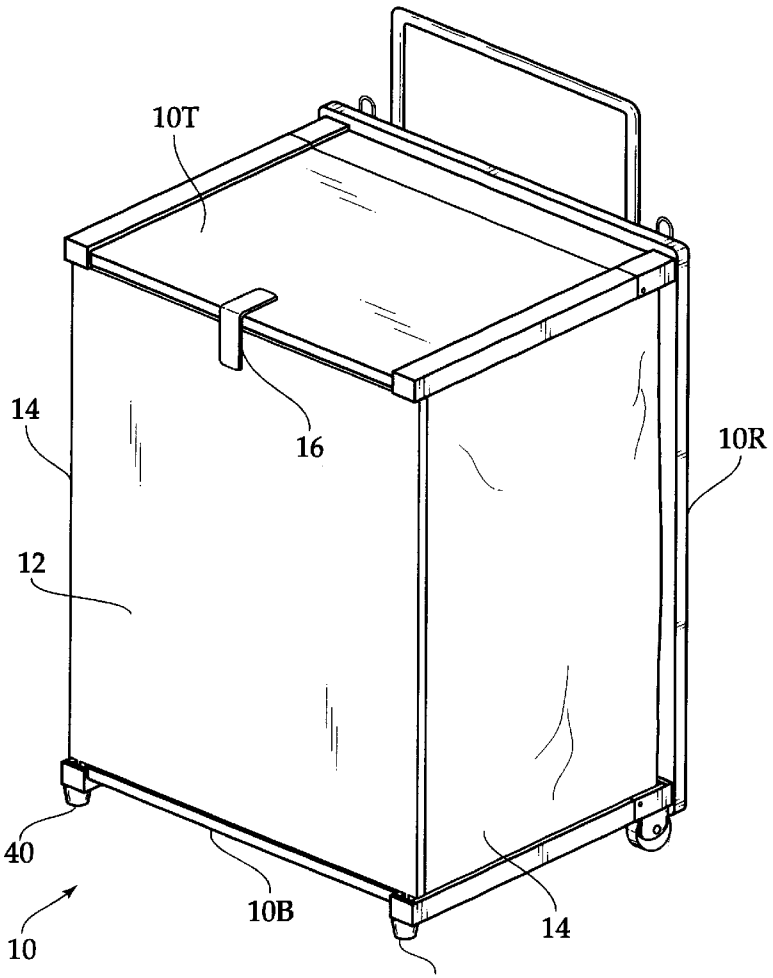
FIG. 1 is a diagrammatic perspective view of the invention, in its fully expanded position, ready for use.

FIG. 1 illustrates a caddy 10, for storing and transporting personal items. The caddy has a top panel 10T, a bottom panel 10B, a rear panel 10R—all of which are rigid. A storage compartment is defined by a rigid partition 12, and soft side panels 14, and is further defined by the bottom panel 10B, rear panel 10R, and the top panel 10T. A closure mechanism 16, namely a zipper with a lock, secures the top panel 10T to the partition 12, to effect closure of the storage compartment.

Figure 2:
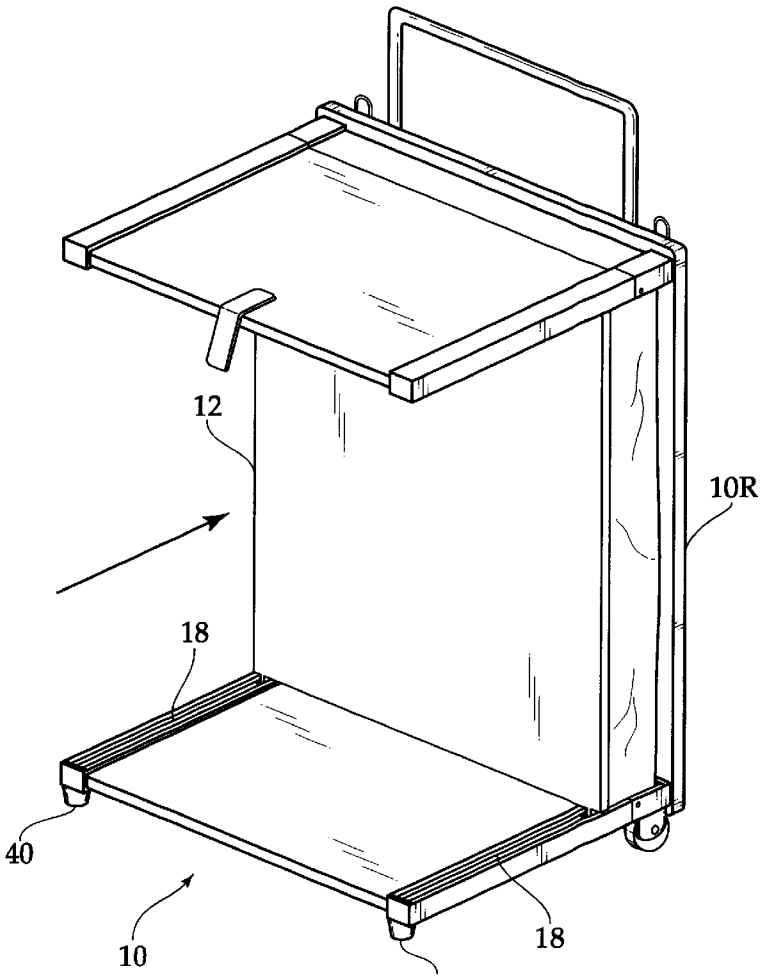
FIG. 2 is a diagrammatic perspective view of the invention, illustrating a first step in collapsing the invention, in which the storage compartment has been collapsed.

As illustrated in FIG. 2, the partition 12 is moveable toward the rear panel 10R in the direction of arrow A, to begin collapsing the caddy 10, by first collapsing the storage compartment. The soft side panels 14 will pleat as the partition 12 is moved toward the rear panel 10R. The bottom panel 10B has a pair of tracks 18 which facilitate movement of the partition 12 toward the rear panel 10R. In fact, In FIG. 2, the partition 12 has been moved nearly fully toward the rear panel 10R.

Figure 3:
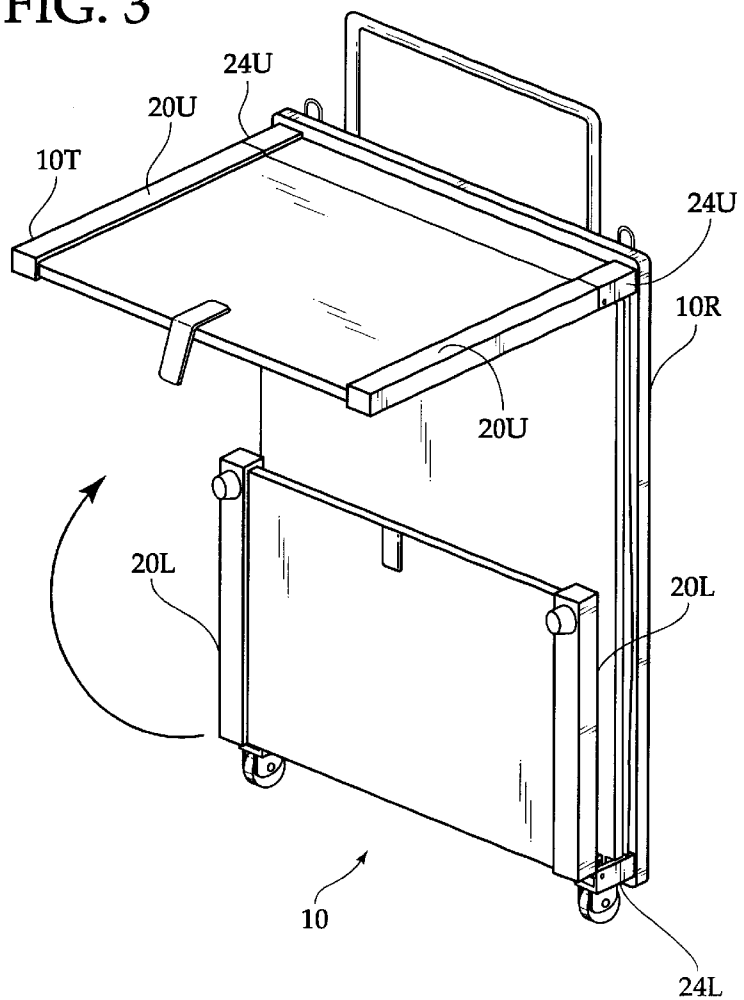
FIG. 3 is a diagrammatic perspective view of the invention, illustrating a second step in collapsing the invention, in which the bottom panel has been folded upward against the rear panel.

Referring now to FIG. 3, the top panel 10T has upper frame members 20U, and the bottom panel 10B has lower frame members 20L, which extend substantially perpendicularly away from the rear panel 10R. The tracks 18 are contained within the lower frame members 20L The upper frame members 20U are attached to the rear panel 10R with upper frame extensions 24U, and the lower frame member 20L, are attached to the rear panel with lower frame extensions 24L.

As seen in FIG. 3, the lower frame members 20L are pivotally attached to the upper frame extensions 24L, so that the bottom panel 10B can fold upward against the rear panel 10R for storage of the caddy 10. The lower frame members 20L each extend from the rear panel 10R a distance sufficient to allow the bottom panel 10B to extend nearly parallel to the rear panel 10R, allowing clearance for the collapsed storage compartment between the bottom panel 10B and rear panel 10R.

Figure 4:
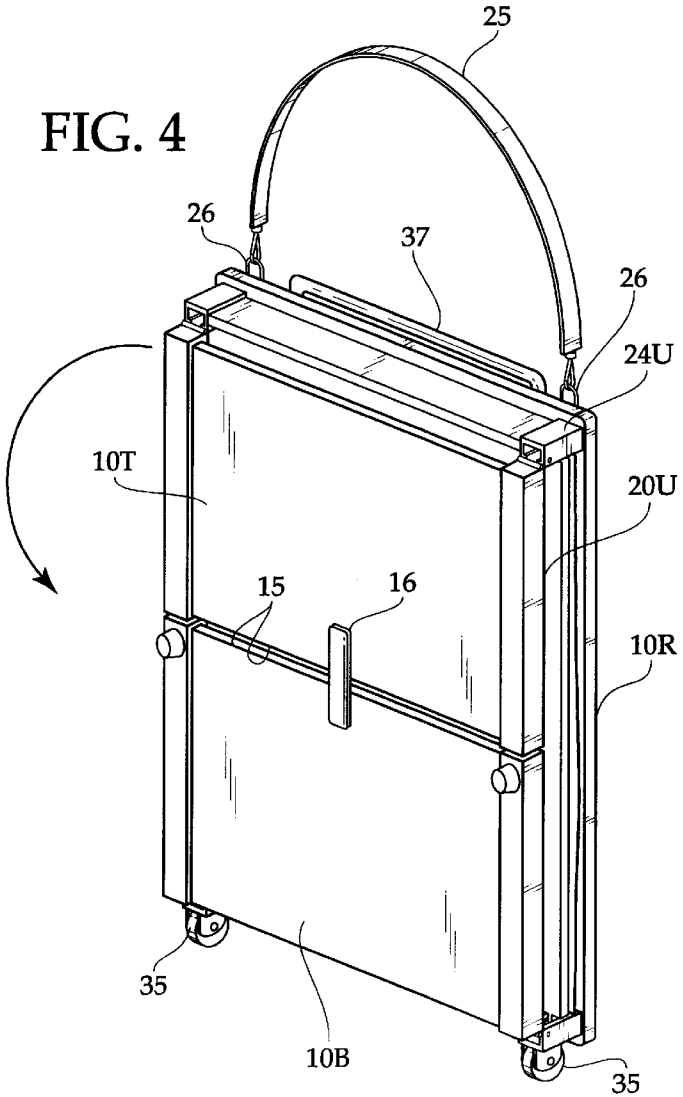
FIG. 4 is a diagrammatic perspective view of the invention, illustrating a third step in collapsing the invention, in which the top panel has been folded downward against the rear panel, and has been affixed to the top panel.

As seen in FIG. 4, the upper frame members 20U are pivotally attached to the upper frame extensions 24U to allow the top panel 10T to fold downward against the rear panel 10R. The upper frame members 20U extend from the rear panel 10R a distance sufficient to allow the top panel 10T to extend nearly parallel to the rear panel 10R, and parallel to the bottom panel 10B in its stored position. As seen in FIG. 4, the bottom panel and top panel both have front edges 15 which nearly abut each other when in their stored positions. Accordingly, the closure mechanism 16 is then used to secure the top panel to the bottom panel near their front edges 15 to maintain the entire caddy 10 in its stored position. A shoulder strap 25 can be attached to the rear panel 10R by means of clips 26 to effect easy transporting of the fully folded caddy 10.

Clearly seen in FIGS. 1–4, a pair of wheels 35 are mounted beneath the caddy, extending immediately below the rear panel, preferably from the lower frame extensions 24L. A handle 37 is provided on the rear panel 10R to facilitate use of the caddy 10. Typically, the handle 37 is retracted as a final step in folding the caddy into storage position.

Figure 5:
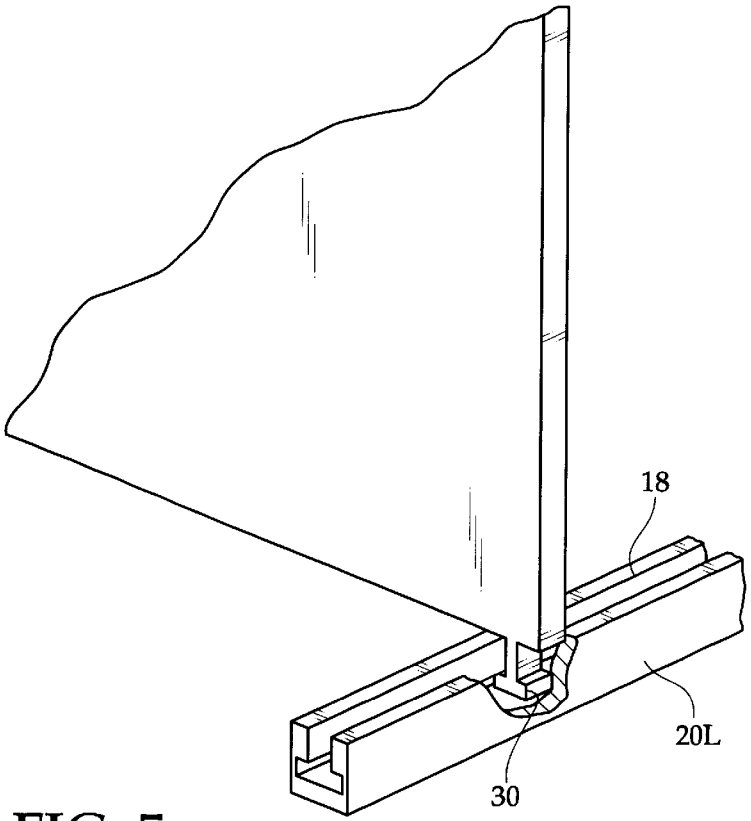
FIG. 5 is a perspective view, with parts broken away, illustrating one of the bottom tracks and the partition of the storage compartment slidably mounted therein.

FIG. 5 illustrates one of the tracks 18 in one of the lower frame members 20L. The partition has a pair of rails 30 which are each slidably mounted within one of the lower frame members 20L to facilitate the partition in sliding toward and away from the rear panel.

Figure 6:
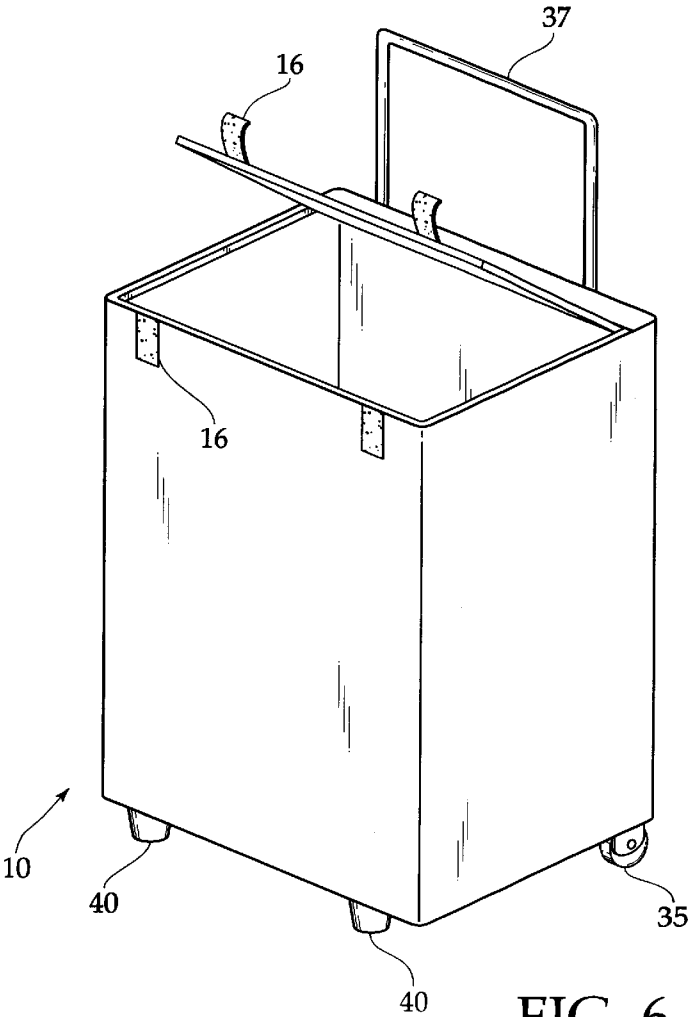
FIG. 6 is a perspective view of another embodiment of the invention—a non-collapsible version having hoop and loop closures.
Figure 8:
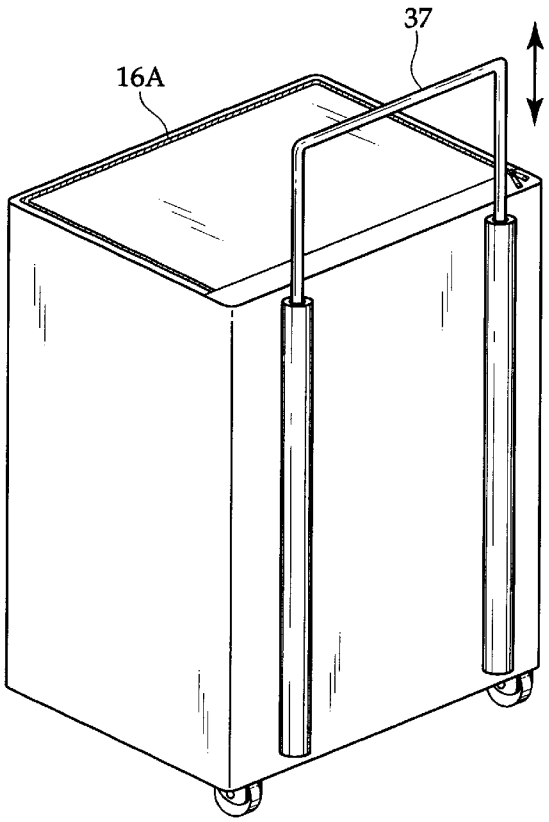
FIG. 8 is a rear perspective view thereof, illustrating operation of the handle.
Figure 7:
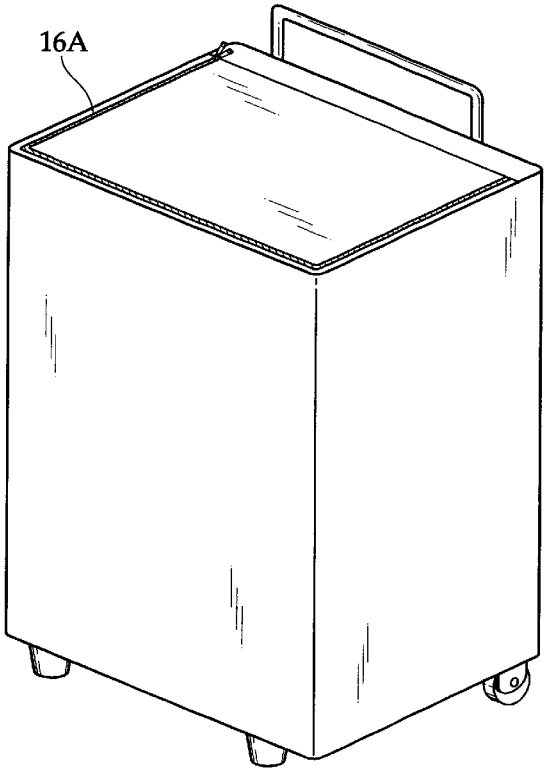
FIG. 7 is a perspective view of another embodiment of the invention, having a zipper closure.

FIGS. 6, 7, and 8 illustrate a simplified, non-collapsible version of the invention. The storage compartment is defined by a rigid shell. A pair of blocks 40 extend downward from the caddy 10 substantially the same distance as the wheels 35. The blocks 40 facilitate leveling of the caddy when it is at rest on a flat surface, and accordingly prevent the caddy from rolling when it is unattended. Also illustrated in FIG. 6, hook and loop closures may be used for the closure mechanism 16. FIG. 7 and FIG. 8 illustrate how the handle 37 may be retracted for storage, or extended for use. In FIG. 8, a zipper closure 16A is used to effect closure of the storage compartment.

In conclusion, herein is presented a caddy which is capable of holding a variety of personal items, including packages and purchased goods, which is particularly useful while shopping.

What is claimed is:

1. A caddy for storing and transporting personal items, comprising:

a rear panel;

a top panel hingeably attached to the rear panel, so that the top panel is capable of extending both perpendicular to the rear panel for ordinary use and parallel to the rear panel for storage;

a bottom panel hingeably attached to the rear panel so that the bottom panel is capable of extending both perpendicular to the rear panel and parallel to the rear panel, said bottom panel having bottom frame extensions which extend perpendicularly from the rear panel, and bottom frame members which are pivotally attached to the bottom frame extensions, both the bottom frame extensions and bottom frame members contain tracks; and a storage compartment, for storing personal items, the storage compartment defined by a partition which extends substantially parallel to the rear panel and soft side panels which extend between the partition and rear panel, and extend substantially between the top panel and bottom panel when the top panel and bottom panel extend perpendicularly from the rear panel, said partition comprising a pair of rails which are slidably mounted within the tracks to facilitate movement of the partition toward and away from the rear panel.

2. The caddy as recited in claim 1, wherein the top panel and bottom panel have front edges, wherein the top panel has a closure mechanism near its front edge, wherein when the top panel and bottom panel are folded toward the rear panel so that they extend nearly parallel to said rear panel the front edges nearly abut each other and the closure mechanism may be used to maintain the caddy in a storage position by affixing the top panel to the bottom panel.

3. The caddy as recited in claim 2, wherein wheels are amounted immediately beneath the rear panel, and a handle is provided on the rear panel.

4. The caddy as recited in claim 3, further comprising a pair of blocks mounted beneath front edge of the bottom panel, extending downward substantially the same distance as the wheels.

* * * * *